US011053678B2

(12) United States Patent
Menzo et al.

(10) Patent No.: US 11,053,678 B2
(45) Date of Patent: Jul. 6, 2021

(54) WALL ELEMENT FOR A PARTITION WALL, AND PARTITION WALL

(71) Applicant: Maars Holding B.V., Harderwijk (NL)

(72) Inventors: Willem Anne Theodoor Menzo, Zwolle (NL); Pieter Marcel De Graaf, Biddinghuizen (NL)

(73) Assignee: Maars Holding B.V., Harderwijk (NL)

( * ) Notice: Subject to any disclaimer, the term of this patent is extended or adjusted under 35 U.S.C. 154(b) by 0 days.

(21) Appl. No.: 16/607,637

(22) PCT Filed: Apr. 19, 2018

(86) PCT No.: PCT/NL2018/050247
§ 371 (c)(1),
(2) Date: Oct. 23, 2019

(87) PCT Pub. No.: WO2018/199741
PCT Pub. Date: Nov. 1, 2018

(65) Prior Publication Data

US 2020/0378112 A1 Dec. 3, 2020

(30) Foreign Application Priority Data

Apr. 24, 2017 (NL) ..... 2018770

(51) Int. Cl.
*E04B 2/74* (2006.01)
*E04B 2/82* (2006.01)
(Continued)

(52) U.S. Cl.
CPC ..... *E04B 2/7401* (2013.01); *E04B 2/828* (2013.01); *E04C 2/384* (2013.01); *E06B 3/70* (2013.01)

(58) Field of Classification Search
CPC ..... E04B 2/7401; E04B 2/828; E04C 2/384; E06B 3/70
See application file for complete search history.

(56) References Cited

U.S. PATENT DOCUMENTS 3,925,948 A * 12/1975 Sauer ..... E04B 2/789 52/481.2
3,958,388 A * 5/1976 Hawes ..... E04B 1/617 52/584.1
(Continued)

FOREIGN PATENT DOCUMENTS

GB 2500472 A * 9/2013 ..... E04C 2/384

OTHER PUBLICATIONS

International Search Report for PCT/NL2018/050247 (5 pages). (Year: 2018).*

*Primary Examiner* — Rodney Mintz
(74) *Attorney, Agent, or Firm* — Marcus C. Dawes

(57) ABSTRACT

Wall element (101) for a partition wall (100), comprising a first and a second wall panel (115, 116) extending parallel to each other between an upper side and an underside of the wall element, wherein the wall element (101) is configured close to the upper side and the underside thereof to be arranged standing upright between a horizontal upper post (103) to be mounted on a ceiling and a horizontal lower post (102) to be mounted on a floor, wherein an elongate profile (122) which extends between the upper and underside is arranged between the first and the second wall panel (115, 116) close to a lateral end surface of the wall element (101), and one of the first and the second wall panel (115, 116) extends beyond the other of the first and the second wall panel (115, 116) in horizontal direction, and wherein an elongate covering element (117) extending between the upper side and underside is arranged on the profile (112) on an outer side of the lateral end surface.

6 Claims, 3 Drawing Sheets

(51) Int. Cl.
*E04C 2/38* (2006.01)
*E06B 3/70* (2006.01)

(56) References Cited

U.S. PATENT DOCUMENTS

| | | | | | |
|---|---|---|---|---|---|
| 4,825,610 | A | | 5/1989 | Gasteiger | |
| 5,020,290 | A | | 6/1991 | Hajjar | |
| 6,094,875 | A | * | 8/2000 | Laine | E04B 2/7453 52/126.3 |
| 6,820,388 | B2 | * | 11/2004 | Newhouse | B25B 5/003 52/223.7 |
| 7,975,445 | B2 | * | 7/2011 | Parshad | E04B 2/7425 52/239 |
| 2010/0307080 | A1 | * | 12/2010 | Parshad | E04B 2/7425 52/220.7 |
| 2016/0348359 | A1 | * | 12/2016 | Behrens | E04B 2/828 |
| 2020/0048900 | A1 | * | 2/2020 | Menzo | E06B 5/16 |
| 2020/0370297 | A1 | * | 11/2020 | Lundholm | E04C 2/08 |

* cited by examiner

WALL ELEMENT FOR A PARTITION WALL, AND PARTITION WALL

The present invention relates to a wall element for a partition wall, comprising a first and a second wall panel extending parallel to each other between an upper side and an underside of the wall element, wherein the wall element is configured close to the upper side and the underside thereof to be arranged standing upright between a horizontal upper post to be mounted on a ceiling and a horizontal lower post to be mounted on a floor. The present invention further relates to a partition wall comprising a horizontal upper post to be mounted on a ceiling, a horizontal lower post to be mounted on a floor, a wall element to be arranged between the upper post and the lower post, comprising a first and a second wall panel extending parallel to each other between an upper side and an underside of the wall element, and a door configured to be placed in line with the wall element as part of the partition wall.

Known partition walls are used in various kinds of interior construction, for example in office buildings, airports, hospitals, industrial estates, public institutions, schools, hotels, cinemas and retail establishments. Doors in the known partition walls are generally placed with interposing of a door frame, which is configured such that it forms a stop for a door, that a door remains closed in its closed state by means of a recess provided in the door frame, and that it provides mechanical stability to the door and the adjacent wall parts. For aesthetic reasons there is further an increasing demand for partition wall components which are optionally integrally formed and which connect substantially seamlessly to each other, such as frameless doors. The use of frameless doors is however at odds with the preference for modular construction of partition walls from prefabricated components as far as possible in respect of dimensions and choice of materials.

It is an object of the invention to improve the prior art, i.e. to provide a high-grade partition wall which meets the high demands regarding the appearance of the partition wall, wherein a frameless door can be applied without being to the detriment of the modular construction of the partition wall from prefabricated components.

According to a first aspect, the invention provides for this purpose a wall element of the type stated in the preamble, with the special feature that an elongate profile which extends between the upper and underside is arranged between the first and the second wall panel close to a lateral end surface of the wall element, and one of the first and the second wall panel extends beyond the other of the first and the second wall panel in horizontal direction, and wherein an elongate covering element extending between the upper side and underside is arranged on the profile on an outer side of the lateral end surface. The profile arranged between the first and the second wall panel provides mechanical stability to the wall element at the position of the profile, whereby said lateral end surface can function as vertical door post from a mechanical viewpoint. A particular advantage of the one wall panel extending beyond the other one in horizontal direction is that it can function as a stop for closing thereagainst a door to be placed in the partition wall. The elongate covering element has the particular advantage that the profile is concealed from view, especially when the first and the second panel are manufactured from a non-transparent material such as steel, which gives the partition wall a substantially seamless and sleek appearance, also at the position of the substantially invisible transition between the wall element and a door to be placed adjacently thereof and substantially directly thereagainst. In addition to the stiffening function of said profile, the elongate covering element also provides stiffness to the wall element at the position of the profile and the covering element. In other words, the invention provides a wall element for a partition wall which functions in aesthetically high-quality manner as a frame for a door to be placed thereagainst. It is noted that the profile and the covering element are not necessarily only mutually co-acting separate components, but can also be manufactured integrally together. It is also noted that the profile can comprise at least a part of a vertical wall post, preferably of a clamping post, of the partition wall.

In a preferred embodiment the profile has an at least substantially U-shaped cross-section comprising a base and two legs, wherein the covering element is arranged on the base and wherein each leg comprises a laterally outward directed wing. The wing is preferably formed such that it can receive a tongue of at least one of the wall elements thereunder for the purpose of attaching said one wall element to the profile.

In a preferred embodiment the covering element has a substantially L-shaped cross-section, comprising a first leg extending in the depth direction of the wall element and a second leg lying at least substantially perpendicularly thereof and extending in the width direction of the wall element, wherein the covering element is arranged such that the first leg covers the profile and the second leg covers at least a portion of the one of the first and the second wall panel which extends beyond the other of the first and the second wall panel in horizontal direction. A covering element with such a form imposes the position of the covering element on the profile and said one wall panel and covers a possible gap between the profile and said one wall panel. A particular advantage hereof is that a neat finish of the lateral end surface of the wall element is achieved. A thickness of the covering element preferably lies between 1 mm (0.039 inch) and 5 mm (0.197 inch), more preferably between 1 mm (0.039 inch) and 3 mm (0.118 inch). A particular advantage of such a thin covering element is that a door to be placed can be arranged very closely against and thus substantially directly against the wall element.

In a preferred embodiment a side of the second leg of the L-shaped covering element remote from the second wall panel is provided over at least substantially the whole length of the covering element with a strip of elastically deformable material. Such a strip of elastically deformable material on the one hand provides for a good seal between a door to be placed and the wall element, which provides draught exclusion and sound insulation. On the other hand, it provides for a damping of a closing movement of the door to be placed when it closes against the wall panel functioning as stop.

In a preferred embodiment the covering element and the profile each comprise an opening situated at substantially the same position for receiving therein a locking element of a lock of a door to be arranged in the partition wall. In this way the profile and the covering element function as a door frame provided with a lock for a door to be arranged in the partition wall.

In a preferred embodiment the covering element and/or the profile is made at least partially of a heat-insulating material in order to thermally disconnect the first and second wall panels from each other. A particular advantage of such a covering element and/or profile is that it helps prevent undesirably large gaps from being created between the wall element and the door in the case of fire, particularly in partition walls manufactured from steel. This greatly enhances the fire-resistance of such partition walls.

In a preferred embodiment the first and the second wall panel are manufactured from at least one from the group of the following materials: steel, glass, plastic and wood. In other words, the door provides an integral system solution for partition walls for diverse fields of application.

According to a second aspect, the invention provides a partition wall of the type stated in the preamble, with the special feature that the wall element is a wall element according to any of the foregoing claims, wherein the door is placed at least substantially directly against the covering element arranged on the profile, and wherein the one of the first and the second wall panel which extends beyond the other of the first and the second wall panel in horizontal direction forms a stop for a door leaf of the door. Since the partition wall comprises a wall element according to an embodiment of the present invention it is possible to realize a substantially invisible transition between the wall element and the door to be placed adjacently thereof and substantially directly thereagainst. In other words, the invention provides a partition wall consisting of a wall element which functions in aesthetically high-quality manner as a frame for a door to be placed thereagainst.

In a preferred embodiment adjusting means configured to adjust the door leaf in the height relative to the floor are provided close to at least one of the underside and the upper side of the door leaf. Using these adjusting means it is possible to arrange the door leaf at a desired height relative to the floor and the ceiling, whereby it is easily possible to compensate for unevenness in the floor and/or the ceiling (for example in the case of a floor and/or ceiling which is not level), while the height dimension of the door leaf can be made as great as possible in order to bring about the most seamless connection possible to the floor and the ceiling. This is because the invention makes it possible to adjust the door leaf in the height relative to the floor surface and ceiling surface and then fix it in the desired position. Moreover, at least the lower edge, and preferably also the upper edge, of the door leaf can be placed at the same height as a lower edge, preferably also an upper edge, of one of the adjacent first and second wall panels. This provides the particular advantage that the adjustments which are generally essential for frameless doors, such as making the doors for placing to size and precisely positioning and adjusting the hinges, are not necessary. In other words, the invention provides on the one hand an aesthetically high-quality door module which, visually, almost disappears in a partition wall constructed from wall elements. On the other hand, the door meets the demands of modularity of partition walls, since the dimensioning and the choice of material of the door can be predetermined before it is placed on location as part of a partition wall between the wall elements thereof.

In a preferred embodiment the adjusting means comprise a first elongate profile and a second elongate profile formed correspondingly to the first profile, wherein the first and the second profile extend in the width direction of the door and wherein the first profile is fixedly connected to the door leaf and is configured such that it forms a receiving element for receiving the second profile therein in releasably attachable and height-adjustable manner, and a hinge element connected to the second profile for pivoting the second profile about a vertical axis of the door leaf, wherein the hinge element can be mounted on a wall and/or one of the floor and the ceiling. The door leaf therefore supports on the second profile and the hinge element connected thereto. The combination of the two profiles, wherein the one profile can be received in height-adjustable manner in the other profile, provides as it were a telescopic construction whereby the door leaf of the door can be adjusted in the height relative to the floor and the ceiling. A space between the first and the second profile preferably comprises an element of sound-insulating material, which contributes to the intended high functional quality of the door. It is noted that the door leaf preferably comprises a self-supporting construction. The door leaf particularly comprises a self-supporting door shell, preferably a self-supporting assembly of an inner and an outer door shell.

In a preferred embodiment the first elongate profile has a U-shaped cross-section and a base of the U-shaped cross-section is fixedly connected to the door leaf such that legs of the U-shaped cross-section extend at least substantially parallel to the vertical axis from the base in a direction remote from the door leaf, and a cross-section of the second elongate profile is formed such that it is releasably attachable to the first profile, such that it is adjustable along the vertical axis relative to the first profile. The second elongate profile preferably has a U-shaped cross-section and the bases of the U-shaped cross-sections of the first and the second profile are directed away from each other or directed toward each other, and the distance between the bases of the U-shaped cross-sections of the first and the second profile is preferably adjustable in order to adjust the door leaf in the height.

In a preferred embodiment the door leaf comprises a self-supporting construction. This self-supporting construction preferably comprises first and second shells disposed parallel to each other and opposite each other and extending in the plane of the partition wall, wherein the first and second shells are thermally disconnected from each other. The first and second shells are more preferably manufactured from steel, wherein a fire-resistant material, such as a gypsum fibre board, is arranged between the first and second shells in order to thermally disconnect the first and second shells from each other. A particular advantage of a door embodied in such a manner is that it helps prevent undesirably large gaps from being created between the wall element and the door in the case of for instance fire, particularly in partition walls manufactured from steel. This greatly enhances the fire-resistance of such partition walls. It is noted that the first and second shells preferably form a front side and a rear side of the door leaf.

In a preferred embodiment the door further comprises height-adjustable spacing means between the bases of the U-shaped cross-sections of the first and the second profile for the purpose of adjusting the distance between said bases. Such spacing means can be embodied as adjusting screws or wedges or made-to-measure spacer blocks of inelastic material. The spacing means preferably comprise the above stated element of sound-insulating material. In the preferred embodiment wherein the bases of the U-shaped cross-sections are directed away from each other the spacing means comprising the sound-insulating material are in particular arranged, optionally clamped, between said bases.

In a preferred embodiment the cross-section of the second profile is dimensioned such that the legs of the U-shaped cross-section of the first profile embrace the second profile, such that the first profile engages, optionally clampingly, on the second profile. As stated, the first and second profiles preferably take a telescopic form, wherein unevenness in the floor and/or the ceiling can be compensated by means of mutually sliding the profiles telescopically into or out of each other. The relative height position of the first and second profiles can thus be adjusted, and be fixed using spacing means between the profiles, such as spacer blocks.

In a preferred embodiment the door further comprises at least a third elongate profile which extends in the width direction of the door and is formed and dimensioned such that it engages, optionally clampingly, on the second profile. Such a third profile is preferably provided with an elongate strip of optionally elastic and draught-excluding and/or sound-insulating material which is arranged over substantially the whole length of the third profile on a side of the third profile directed toward the floor and/or the ceiling. A strip of such material is preferably dimensioned such that this strip is at least in contact with the floor and/or the ceiling when the door is closed. The third profile is preferably arranged for moving slidably along the vertical axis relative to the second profile. A particular advantage of such a third profile movable in the height is that, in combination with the strip of optionally elastic and draught-excluding and/or sound-insulating material, it can function as a drop seal. Such a third profile with said strip, functioning as door seal or drop seal, is preferably arranged on either side, i.e. on the front side and the rear side, at the position of the underside and/or upper side of the door.

In a preferred embodiment the door leaf comprises close to at least one of the underside and the upper side of the door leaf a recess extending in the width direction of the door for at least partially receiving therein at least one of the first, the second and the third profile. A particular advantage of such a recess is that the height dimension of at least one of the visual surfaces of the door leaf can be maximized in order to realize the most seamless connection possible to the floor and/or the ceiling.

In a preferred embodiment the second profile comprises close to a longitudinal outer end thereof a recess for receiving therein a mounting part of the hinge element. As stated, the door leaf supports via the first profile and the spacing means on the second profile which is connected to the hinge element, whereby the height of the door leaf relative to the hinge element and therefore relative to the floor and/or the ceiling can be adjusted.

In a preferred embodiment the hinge element comprises a pivot hinge and the recess is configured to receive therein a pin of the pivot hinge. A particular advantage of such a pivot hinge is that it substantially disappears in the door leaf, so that it is at least substantially invisible when the door is arranged in the partition wall.

In a preferred embodiment the hinge element comprises a pivot hinge and the second profile comprises close to a longitudinal centre thereof a recess for receiving therein a pin of the pivot hinge. As a result, the door is rotatable about its longitudinal axis. A particular advantage hereof is that the centre of gravity of the door lies above the axis of the pin of the pivot hinge. In other words, the point of rotation of the door lies directly below the centre of gravity of the door. This results in a balanced distribution of the weight of the door relative to the point of rotation. This prevents lateral forces being exerted on the hinge pin. This results in less (to no) wear of the hinge element and a lighter operation of the door compared to pivot-hinged doors wherein the pivot hinge is arranged eccentrically relative to the longitudinal axis of the door. A pivot hinge arranged close to the longitudinal centre moreover enables the door to be rotated through 360 degrees. A particular advantage hereof is that a front and a rear side of the door can be turned both toward the inside and toward the outside of the space to be partitioned with the partition wall. An entirely different door appearance can thus be created by simply turning the door around.

In a preferred embodiment the pivot hinge comprises a mounting part for mounting the pivot hinge on the floor or the ceiling, and a locking mechanism for locking the door in a plurality of predetermined angular positions relative to a frontal plane of the wall. A significant advantage of such a locking mechanism is that the door can be fixed in its closed position or in various open positions. The accessibility to the space to be partitioned with the partition wall can be controlled in this way.

The locking mechanism preferably comprises a locking member arranged in the second profile under spring pressure, and locking holes formed correspondingly to the locking member and arranged in the mounting part at a mutual distance along a circle, wherein the locking member is resiliently movable between a rest position, in which the locking member extends into one of the locking holes in the mounting part, and a retracted position in which the locking member is situated at least substantially wholly in the second profile. The positions of the locking holes along the circle determine the positions in which the door can be locked relative to the frontal plane of the partition wall.

An outer wall of the locking member and/or an inner wall of each of the locking holes is preferably chamfered or rounded such that the locking member can be carried from its retracted position to its rest position in a manner in which it snaps into the locking holes only by means of rotation of the door, and vice versa.

In another preferred embodiment the hinge element comprises a paumelle hinge, and the second profile is configured close to a longitudinal outer end thereof for mounting thereon a mounting part of the paumelle hinge. A particular advantage of such a paumelle hinge is that it allows the door connected thereto to move between a closed and an open position through an angle of 180 degrees. The door can hereby be placed at least substantially flat against the adjacent wall element, which ensures that, in its open position, as little of the door as possible is situated in the passage of the door opening. This is particularly advantageous in situations where a continuous passage is desired for a longer period of time.

The hinge element preferably comprises a spring element and/or spring mechanism for urging the door into a predetermined position using spring force. In this way it can for instance be achieved that an opened door always falls shut, in a manner which may or may not be controlled, in the plane of the partition wall or remains open perpendicularly of the plane of the partition wall.

In a preferred embodiment the first and the second wall panel and the door leaf of the door have the same height dimension and at least the lower post extends up to the door, such that the lower post does not extend under the door. The upper post preferably likewise extends up to the door, such that the upper post does not extend above the door. Since the door can be arranged directly against the vertical post and the lower post and the upper post do not extend respectively under and above the door, the door can be placed substantially seamlessly between adjacent wall elements and floor and ceiling lying below and above. At least one of the first and second wall panel and the door leaf are preferably arranged at the same height above the floor, such that a horizontal lower edge of the at least one of the first and second wall panel and a horizontal lower edge of the door leaf lie mutually in line at the same height above the floor.

In a preferred embodiment the wall element and the door are manufactured from the same material, wherein the material is chosen from the following group of materials: steel, glass, plastic and wood. A partition wall wherein the wall element and the door are made from the same material contributes to the aesthetically high-quality appearance thereof and meets the increasing demand for integrally formed partition wall components which connect seamlessly to each other.

In a preferred embodiment the lower post and/or the upper post comprise a first, second and third elongate profile with a U-shaped cross-section, wherein the first profile is mounted with a base of its U-shaped cross-section on the floor, wherein the second profile is arranged on the first profile, wherein bases of the U-shaped cross-sections of the first and the second profile are directed away from each other, wherein the third profile is arranged between the first profile and the second profile, wherein bases of the U-shaped cross-sections of the first and third profiles are directed away from each other. It is hereby easily possible to compensate for unevenness in the floor and/or ceiling (for example in the case of a floor and/or ceiling which is not level), while the height of the lower post and/or upper post can be made as small as possible. This is because the invention makes it possible to adjust the first, second and third profiles in the height relative to each other, relative to the floor and/or the ceiling, and then fix them in a desired position. The legs of the U-shaped cross-sections of the first, second and third profiles of the lower post and/or upper post particularly comprise mutually co-acting ridges in order to prevent for instance the second and third profiles dropping down during installation. The first, second and third profiles preferably take a telescopic form, wherein unevenness in the floor and/or the ceiling can be compensated by means of mutually sliding the profiles telescopically into or out of each other. The relative height position of the first, second and third profiles can thus be adjusted, and be fixed using spacing means between the profiles, such as spacer blocks.

In a preferred embodiment the base of the U-shaped cross-section of the second profile comprises a resilient clamping profile arranged thereon, and the first and/or the second wall panel comprises, arranged on its lower edge, an inward extending tongue arranged clampingly between the base of the U-shaped cross-section of the second profile and the resilient clamping profile in order to attach the first and/or the second wall panel to the lower post and/or the upper post. It is hereby easily possible to place the panel in the wall (by moving the panel in vertical state in horizontal direction, whereby the tongue is received in a slot of the clamping profile), anchor it therein and, if desired, remove it again. The panel is preferably a glass panel, wherein the tongue arranged on its lower edge extends inward, i.e. is directed toward the wall. At least two panels are preferably placed on either side of the lower post and the upper post, wherein the panels are arranged clampingly between the upper post and the lower post. The use of a clamping profile enables the wall to be made to any desired length, for instance by sawing, whereby varying dimensions can be easily achieved with one (standard) clamping profile. The tongue arranged on the lower edge of the first and/or the second wall panel and the tongue arranged on the upper edge of the first and/or the second wall panel preferably extend along the whole width of the panel. The tongue arranged on the lower edge of the first and/or the second wall panel and the tongue arranged on the upper edge of the first and/or the second wall panel are more preferably each provided with a profiled, longitudinal insertion edge. The insertion edges preferably comprise an obliquely rising insertion surface.

The present invention is further elucidated on the basis of the following figures which show preferred embodiments of the door and the partition wall according to the present invention and are not intended to limit the scope of protection of the invention in any way, wherein.

Figures 2, 3, 4:
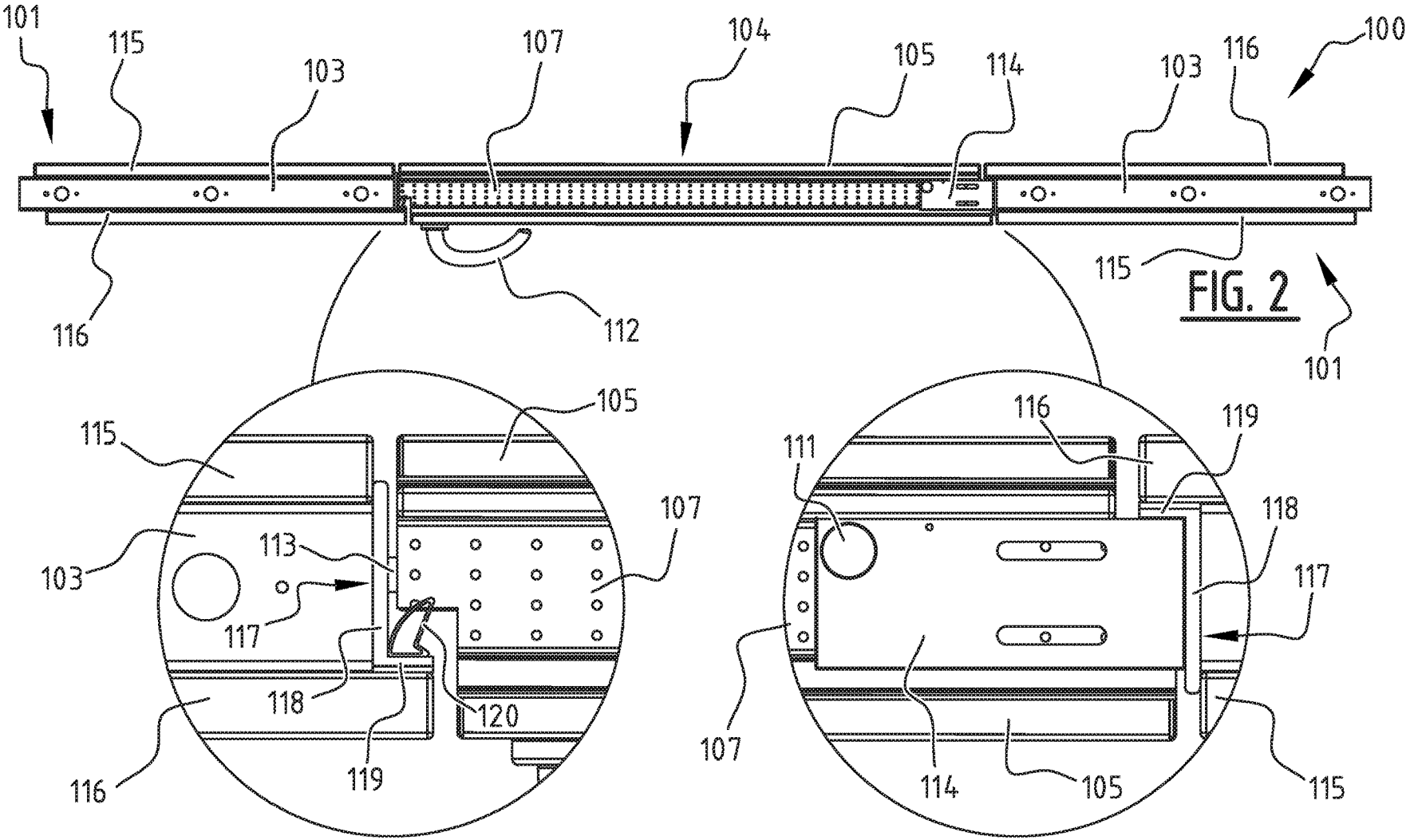
FIG. 2 shows a top view of the partition wall according to FIG. 1.
Figure 5:
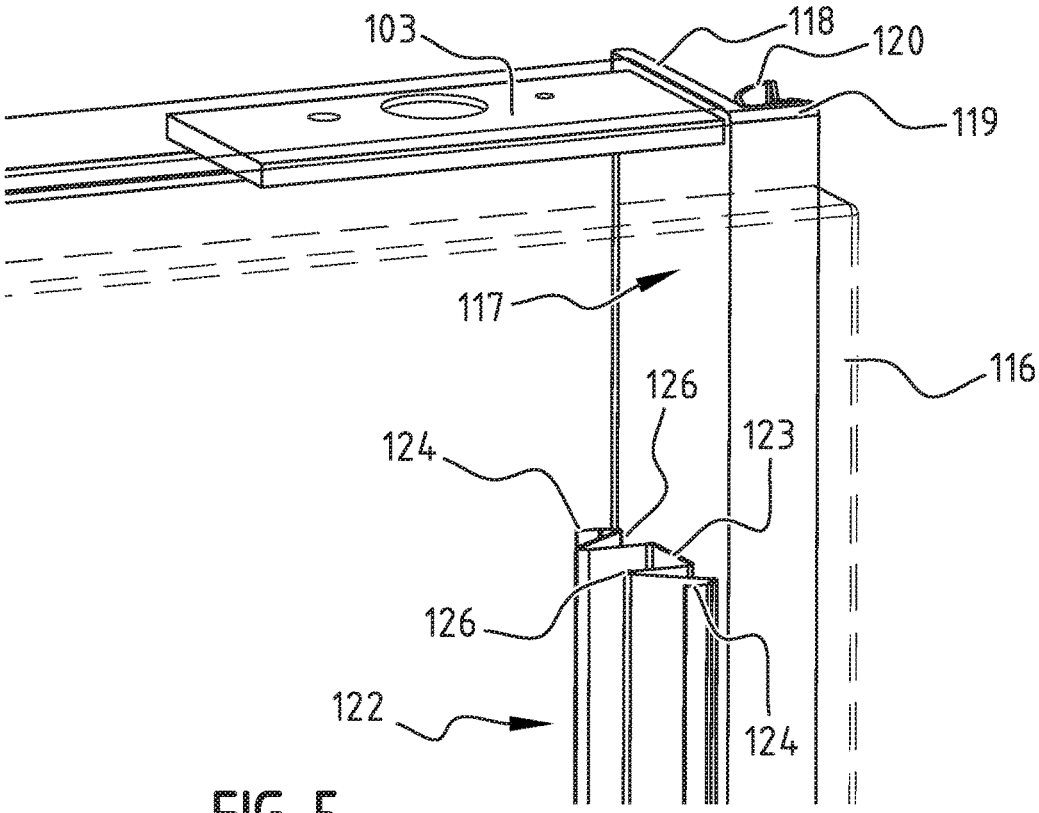
Figure 6:
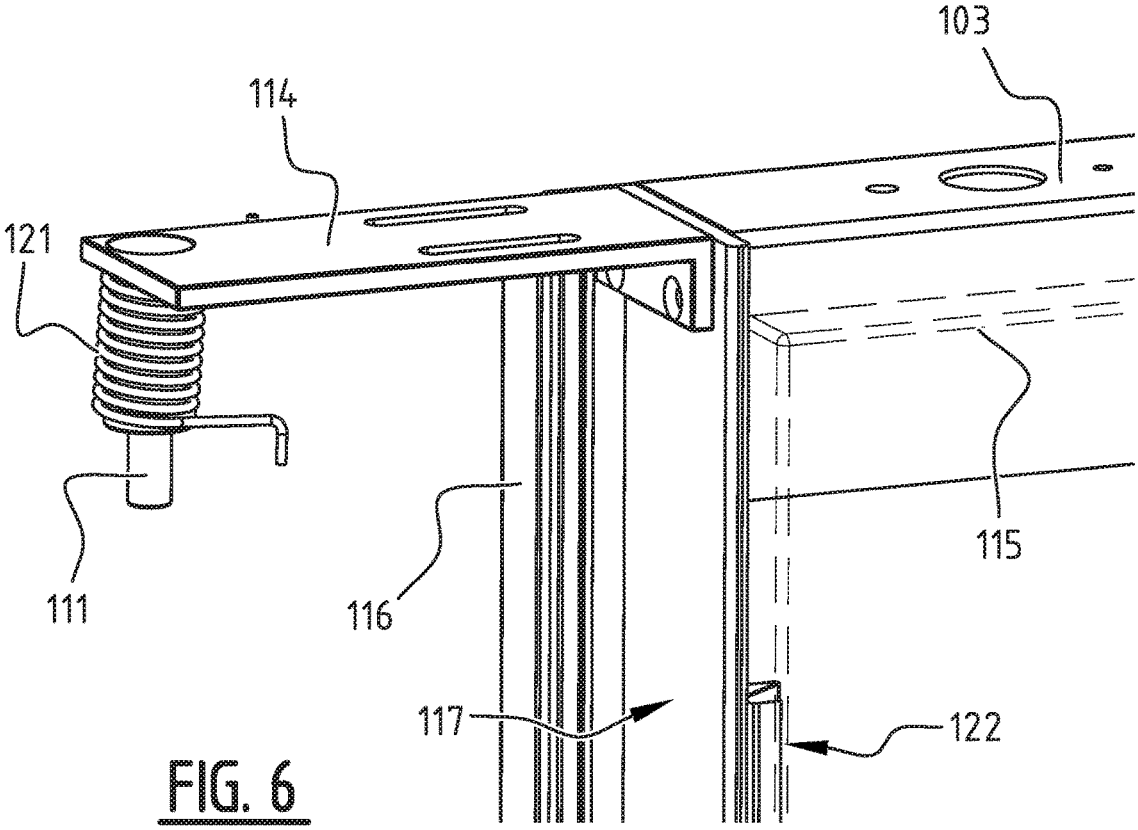

FIGS. 3 and 4 each show a detail of FIG. 2 in top view;

FIGS. 5 and 6 each show a perspective view of the details shown respectively in FIGS. 3 and 4.

Figure 1:
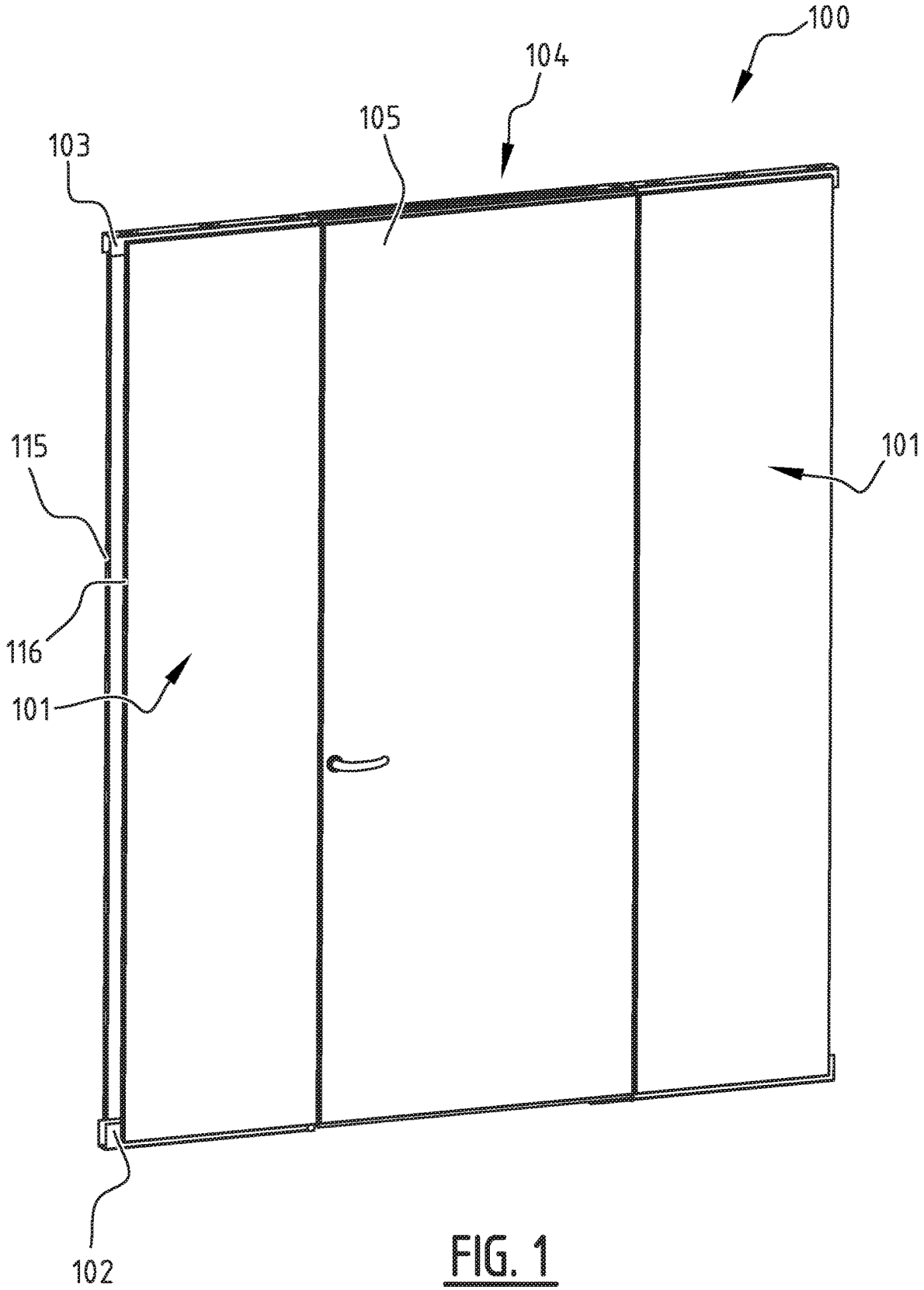
FIG. 1 shows a perspective view of an embodiment of a partition wall according to the invention.

FIG. 1 shows a perspective view of an embodiment of a partition wall 100 consisting of a left-hand and a right-hand wall element 101, a horizontal upper post 103 to be mounted on a ceiling, a horizontal lower post 102 to be mounted on a floor, wherein wall elements 101 are arranged between upper post 103 and lower post 102. Partition wall 100 further comprises a door 104 arranged at least substantially directly against end surfaces of wall elements 101, wherein wall panels 115, 116 and a door leaf 105 of door 104 have the same height dimension. In the shown embodiment lower post 102 and upper post 103 extend up to door 104, such that lower post 102 and upper post 103 do not extend respectively under and above door 104.

FIG. 2 shows a top view of partition wall 100, consisting of a left-hand and a right-hand wall element 101 and a door 104 arranged between lateral end surfaces of wall elements 101.

FIGS. 3 and 4 each show a top view of a detail of FIG. 2 at the position of a transition between an embodiment of wall elements 101 according to the invention and a door 104 to be placed therebetween. FIGS. 5 and 6 show the respective perspective views thereof. In the shown embodiment an elongate profile 122 is arranged between wall panel 115 and wall panel 116 close to a lateral end surface of wall element 101. Elongate profile 122 extends between the upper and underside of wall element 101. Wall panel 116 further extends beyond wall panel 115 in horizontal direction, and an elongate covering element 117 extending between the upper side and underside of wall element 101 is arranged on profile 122 on an outer side of the lateral end surface of wall element 101. The profile 122 arranged between wall panel 115 and wall panel 116 provides mechanical stability to wall element 101 at the position of profile 122, whereby said lateral end surface can function as vertical door post from a mechanical viewpoint. Wall panel 116 further functions as a stop for closing thereagainst a door 104 to be placed in partition wall 100. Elongate covering element 117 ensures that profile 122 is concealed from view, especially when wall panels 115, 116 are manufactured from a non-transparent material such as steel, which gives partition wall 100 a seamless and sleek appearance, also at the position of the substantially invisible transition between wall element 101 and a door 104 to be placed adjacently thereof and substantially directly thereagainst.

Profile 122 further has a U-shaped cross-section with a base 123 and two legs 126, wherein covering element 117 is arranged on base 123 and wherein each leg 126 comprises a laterally outward directed wing 124. The wing 124 is formed such that it can receive a tongue (not shown) of at least one of the wall elements 101 thereunder for the purpose of attaching wall element 101 to profile 122.

Covering element 117 further has an at least substantially L-shaped cross-section. The L-shaped cross-section consists of a leg 118 extending in the depth direction of the wall element and a leg 119 lying perpendicularly thereof and extending in the width direction of the wall element. Covering element 117 is arranged such that leg 118 covers profile 122 and leg 119 covers a portion of wall panel 116.

A covering element 117 with such a form imposes the position of covering element 117 on profile 122 and wall panel 116 and covers a possible gap between the profile and wall panel 116. This results in a neat finish of the lateral end surface of wall element 101.

A side of the leg 119 of L-shaped covering element 117 remote from wall panel 116 is further provided over the length of covering element 117 with a strip 120 of elastically deformable material. Such a strip 120 of elastically deformable material on the one hand provides for a good seal between door 104 and wall element 101, which provides draught exclusion and sound insulation. On the other hand, it provides for damping of a closing movement of door 114 when it closes against the wall panel 116 functioning as stop.

Covering element 117 and profile 122 further each have an opening (not shown) for receiving therein a locking element of a lock of door 104. In this way profile 122 and covering element 117 function as a door frame provided with a lock for the door 104 of partition wall 100.

Finally, provided in the partition wall is a hinge element, a pivot hinge 114, with a pin 111 with a longitudinal axis about which door 104 can rotate pivotally in order to open and close a door opening in partition wall 100 defined by door 104. Hinge element 114 further has a coil spring 121 for urging door 104 into a predetermined position using spring force. In this way it can for instance be achieved that an opened door 104 always falls shut, in a manner which may or may not be controlled, in the plane of partition wall 100 or remains open perpendicularly of the plane of partition wall 100.

The present invention is not limited to the shown embodiments but also extends to other embodiments falling within the scope of protection of the appended claims.

The invention claimed is:

1. Wall element for a partition wall, comprising:

a first and a second wall panel extending parallel to each other between an upper side and an underside of the wall element, wherein the wall element is configured close to the upper side and the underside thereof to be arranged standing upright between a horizontal upper post to be mounted on a ceiling and a horizontal lower post to be mounted on a floor; and an elongate profile which extends between the upper side and the underside is arranged between the first and the second wall panel close to a lateral end surface of the wall element, wherein one of the first and the second wall panel extends beyond the other of the first and the second wall panel in a horizontal direction, wherein an elongate covering element extending between the upper side and the underside is arranged on the profile on an outer side of the lateral end surface, wherein the covering element has an at least substantially L-shaped cross-section, comprising a first leg extending in a depth direction of the wall element and a second leg lying at least substantially perpendicularly thereof and extending in a width direction of the wall element, wherein the covering element is arranged such that the first leg covers the profile and the second leg covers at least a portion of the one of the first and the second wall panel which extends beyond the other of the first and the second wall panel in the horizontal direction, and wherein a side of the second leg of the L-shaped covering element remote from the second wall panel is provided over at least substantially a whole length of the covering element with a strip of elastically deformable material.

2. Wall element as claimed in claim 1, wherein the profile has an at least substantially U-shaped cross-section comprising a base and two legs, wherein the covering element is arranged on the base and wherein each leg comprises a laterally outward directed wing.

3. Wall element as claimed in claim 1, wherein a thickness of the covering element lies between 1 mm (0.039 inch) and 5 mm (0.197 inch).

4. Wall element as claimed in claim 1, wherein the covering element and the profile each comprise an opening situated at substantially the same position for receiving therein a locking element of a lock of a door to be arranged in the partition wall.

5. Wall element as claimed in claim 1, wherein at least one of the covering element or the profile is manufactured at least partially of a heat-insulating material in order to thermally disconnect the first and second wall panels from each other.

6. Wall element as claimed in claim 1, wherein the first and the second wall panel are manufactured from at least one from the group of the following materials: steel, glass, plastic and wood.

* * * * *